US007823311B2

(12) United States Patent
Pitcher et al.

(10) Patent No.: US 7,823,311 B2
(45) Date of Patent: Nov. 2, 2010

(54) EDGE RETAINING GRAPHIC SUPPORT ARRANGEMENT

(75) Inventors: David E. Pitcher, Swampscott, MA (US); Thomas P. Burrous, Haverhill, MA (US); Rebecca C. Suciu, Lynn, MA (US); Sidney Rose, Marblehead, MA (US); Alan L. Stenfors, Scituate, MA (US)

(73) Assignee: Rose Displays, Ltd., Salem, MA (US)

( * ) Notice: Subject to any disclaimer, the term of this patent is extended or adjusted under 35 U.S.C. 154(b) by 0 days.

(21) Appl. No.: 12/384,096

(22) Filed: Mar. 31, 2009

(65) Prior Publication Data

US 2010/0242322 A1 Sep. 30, 2010

(51) Int. Cl.
*G09F 7/18* (2006.01)

(52) U.S. Cl. ..... 40/790; 40/618

(58) Field of Classification Search ..... 40/617, 40/661.11, 668; 24/460, 462; 16/87 R, 87.2
See application file for complete search history.

(56) References Cited

U.S. PATENT DOCUMENTS 3,787,922 A * 1/1974 Foy et al. ..... 16/404
5,090,145 A * 2/1992 Chiang et al. ..... 40/605
5,882,073 A * 3/1999 Burchi et al. ..... 297/218.2
6,076,295 A * 6/2000 Garfinkle ..... 40/605
6,082,687 A * 7/2000 Kump et al. ..... 248/220.41
6,671,988 B2 * 1/2004 Cyrluk ..... 40/617
7,490,424 B2 * 2/2009 Caterinacci ..... 40/606.14
2006/0117630 A1 * 6/2006 Raia et al. ..... 40/658

* cited by examiner

*Primary Examiner*—Cassandra Davis
(74) *Attorney, Agent, or Firm*—Don Halgren

(57) ABSTRACT

A supportive edge retaining graphic display arrangement for supportively holding a display banner in a readily exchangeable manner. The arrangement comprises an elongated, generally "U"-shaped, extruded first or inner housing having an upper elongated flange, and an arrangement of opposed, spaced apart, aligned display panel engaging ribs on side walls thereof extending oppositely from a flange supporting bridge member, an outer elongated extruded outer housing having an inner channel for sliding receipt of the elongated flange of the inner housing, and a display panel having an elongated fastener member attached to an upper end thereof, wherein the elongated fastener member has a plurality of aligned engagable elements extending outwardly therefrom, the aligned engagable elements being in spaced alignment with the ribs on the inner housing for sliding longitudinal engagement therewith.

3 Claims, 5 Drawing Sheets

EDGE RETAINING GRAPHIC SUPPORT ARRANGEMENT

BACKGROUND OF THE INVENTION

1. Field of the Invention

This invention relates to graphic support arrangements and more particularly, to extrusions which retain applied strip material on a rigid or flexible display panel.

2. Prior Art

In commercial advertising such as may be found in retail stores, markets and malls, sheets of display panels and banners are often put up and taken down frequently. Often when those display panels are flexible the upper edge and sometimes the lower edge of those panels may have an elongated pocket for receipt of a dowel, by which that display is supported. This makes that display panel a more expensive way to advertise in a constantly changing environment.

It is an object of the present invention to provide an improvement over the method of the prior art for supporting either a rigid or a flexible banner from an overhead support, banner stand, or any other areas where displaying a sign is desired.

It is yet a further object of the present invention to provide an apparatus and method to facilitate support and exchange of a rigid or a flexible banner from an overhead support, banner stand, or any other areas where displaying a sign is desired.

It is a further object of the invention to provide preliminary support components onto rigid or flexible banners which components may be applied during the banner printing process.

BRIEF SUMMARY OF THE INVENTION

The present invention comprises a first or "inner" elongated extrusion housing slidably receivable within a second or "outer" elongated extrusion housing. The first or inner elongated extrusion is arranged to, by itself, slidably receive the upper edge and sometimes with another first extrusion, also receive the lower edge of a display panel in one preferred embodiment, or in conjunction with an outer housing in a further preferred embodiment. The outer elongated extruded housing, in that latter preferred embodiment, is arranged to slidably receive the elongated extruded inner housing with its associated display panel supported therewithin. The outer elongated extruded housing may be supported by an overhead support member (i.e. cable) which extends downwardly from an overhead ceiling rail or the like.

The first or inner elongated extrusion comprises a first or left side wall and a second or a right side wall joined together by an elongated bridge member along an upper edge thereof. The bridge has a T-shaped support flange projecting therefrom. The bridge and the first side wall and the second side wall form a generally inverted U-shaped channel having an open elongated lower end thereon. The first side wall and the second side wall each have a plurality of elongated wedge shaped ribs opposing one another in an aligned, slightly spaced apart relationship. The first side wall and the second side wall also define between them an open inner channel adjacent to the bridge member.

The second or outer elongated extruded housing comprises a first sidewall and a second sidewall in an opposed and spaced apart relationship. A unitary bridge member extends between the first sidewall and the sidewall close to a first or proximal end of the outer housing. The upper proximal end of the sidewalls define opposed proximal ends which are spaced apart to define a slot therebetween. An elongated support receiving channel comprises the space between those proximal ends and the bridge member connecting the spaced-apart sidewalls. A first flange and a second flange, each of "L-shape", may extend distally within an elongated internal chamber from the bridge member between the body portions of the first sidewall and the second sidewall in one of the preferred embodiments. In another preferred embodiment, those flanges extend inwardly from the sidewalls of the outer housing, instead of the bridge member, yet in each embodiment, they define an elongated "flange-receiving" slot therebetween. The first sidewall and the second sidewall of the outer housing have elongated distal ends that are spaced apart and separated from one another at the bottom, so as to define an elongated opened "inner housing" receiving-slot, disposed therebetween.

In one preferred embodiment of the present invention, the elongated extruded first or inner housing is longitudinally slid into the elongated internal chamber between the first sidewall and the second sidewall of the second or outer housing. The T-shaped support flange extending perpendicularly from the bridge member of the elongated extruded inner housing mates within the channel which extends between the first L-shaped flange and the second L-shaped flange within the elongated internal chamber of the elongated extruded outer housing.

A sign or substrate which will be a display panel for use within a commercial establishment, may be a flexible piece of paper or cloth or it may be a rigid piece of plastic or the like. An elongated fastener element is adhered to the uppermost edge and sometimes also to the lower edge of the sign substrate. Such an elongated fastener element may be seen for example, in U.S. Pat. No. 7,478,460, to Gallant et al, which patent is incorporated herein by reference in its entirety. The elongated fastener element, which is for example, found in this patent, has longitudinally aligned wedge-shaped engagement elements. Those engagement elements slide along the parallel, longitudinally-aligned inwardly extending ribs on one or both of the inner sides of the inner channel of the elongated extruded first or inner housing when they are slidably mated together.

The elongated extruded inner housing has a lower or distal end which preferably extends beyond the distalmost ends of the opposed sidewalls of the elongated extruded outer housing when they are longitudinally mated. A printed portion of that substrate, as part of a display, would extend beneath the elongated extruded inner housing and concomitantly extend beyond the elongated extruded outer housing.

A similar elongated extruded inner housing and an elongated extruded outer housing may as a further embodiment, be situated along the lower edge of the display panel in a properly supported relationship. The lower end of the display panel would have a similar elongated fastener element attached thereon. Those elongated fastener elements would be preferably placed on the display panel during and or immediately subsequent to the printing of that display panel advertisement.

The elongated extruded outer housing would have an end cap on each end thereof, so as to permit a display panel slid therewithin, to remain securely trapped therewithin until it is desired to have it removed or changed, so that first or inner housing is slid longitudinally out from the elongated second or outer housing.

In another embodiment, the inner housing would be used alone to retain the edge of a sign for suspension from an overhead support, banner stand or the like. In this embodiment, the housing might have features such as a clip-receiving rail for hanging from an above support or for attachment to a floor stand or the like.

The invention thus comprises a supportive edge retaining graphic display arrangement for supportively retaining a display banner in a readily exchangeable manner comprising: an elongated, generally U-shaped, extruded, first or inner housing having an upper elongated flange, and an arrangement of opposed, spaced apart, aligned display panel engaging ribs on side walls thereof; an outer elongated extruded outer housing having an inner channel for sliding receipt of the elongated flange of the inner housing; and a display panel having an elongated fastener member attached to an upper end thereof, wherein the elongated fastener member has a plurality of aligned engagable elements extending outwardly therefrom, the aligned engagable elements being in spaced alignment with the ribs on the inner housing for sliding longitudinal engagement therewith. The extruded inner housing preferably has an upper elongated engagement flange thereon. The support arrangement may include an elongated extruded outer housing having an elongated inner channel defined by a pair of spaced apart opposed flanges, for sliding receipt of the upper elongated engagement flange of the first or inner housing. The elongated flange preferably is of T-shape. The ribs on the inner housing are preferably of wedge shape in cross-section. The display panel may have an elongated fastener element applied to a lower edge thereof. The elongated fastener element may be applied concomitantly with printing of a display message thereon. An end cap is preferably arranged on each end of the outer housing.

The invention also comprises a method for supporting a display panel from an upper housing comprising one or more of the following steps, comprising: forming an array of longitudinally aligned ribs within a pair of parallel opposed walls of an elongated extruded first or inner housing; attaching an elongated fastener element onto an upper edge of the display panel; and sliding the upper edge of the display panel with the elongated fastener element thereon into the inner housing between the opposed walls having longitudinally aligned ribs therewithin; sliding an elongated inner housing longitudinally within an elongated channel in the outer housing. The attaching of the elongated fastener element to the edge of the display panel preferably occurs during a printing operation upon that display panel. The elongated fastener element has a set of longitudinally aligned wedge shaped members arranged thereon.

The invention may also comprise a supportive edge-retaining graphic display arrangement for supportively retaining a display banner in a readily exchangeable manner, the supportive arrangement comprising: an elongated, generally U-shaped, extruded, first housing having an upper "T" shaped elongated flange thereon, extending from a bridge member having an oppositely directed arrangement of opposed, spaced apart parallel side walls, each having aligned, display panel engaging ribs on inner facing side walls thereof; a display panel having an elongated fastener member attached to an upper end thereof, wherein the elongated fastener member has a plurality of aligned engagable elements extending outwardly therefrom, the aligned engagable elements being in spaced alignment with the ribs on the first or inner housing for sliding longitudinal engagement therewith. The supportive edge retaining graphic display arrangement may include an elongated extruded outer housing having an elongated inner channel defined by a pair of spaced apart opposed flanges, for sliding receipt of the upper elongated engagement flange of the inner housing. The ribs on the spaced apart side walls of the first housing are of wedge shape in cross-section. The display arrangement panel may have a lower edge with an elongated fastener element applied thereon. The elongated fastener element may be applied concomitantly with printing of a display message thereon.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 3:
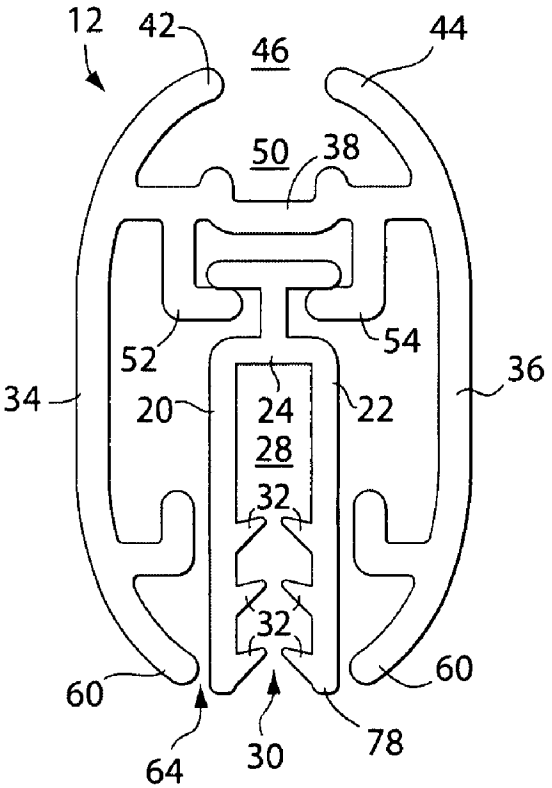
FIG. 3 is an end view of the elongated inner housing mated within the elongated internal chamber of the elongated extruded outer housing.
Figure 2:
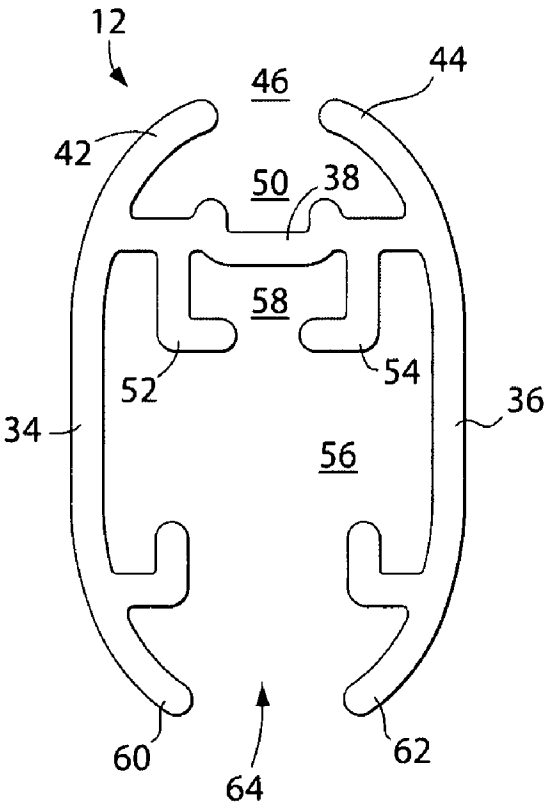
FIG. 2 is an end view of one preferred embodiment of the elongated extruded outer housing.
Figure 1:
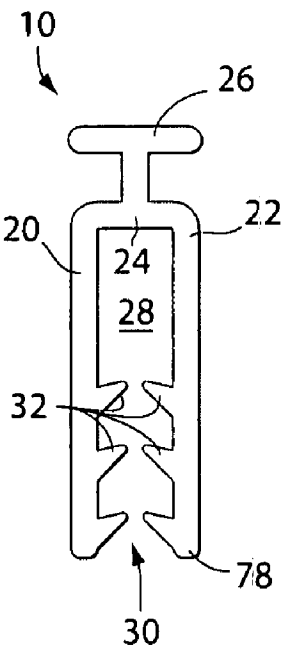
FIG. 1 is an end view of the elongated extruded inner housing.
Figure 5:
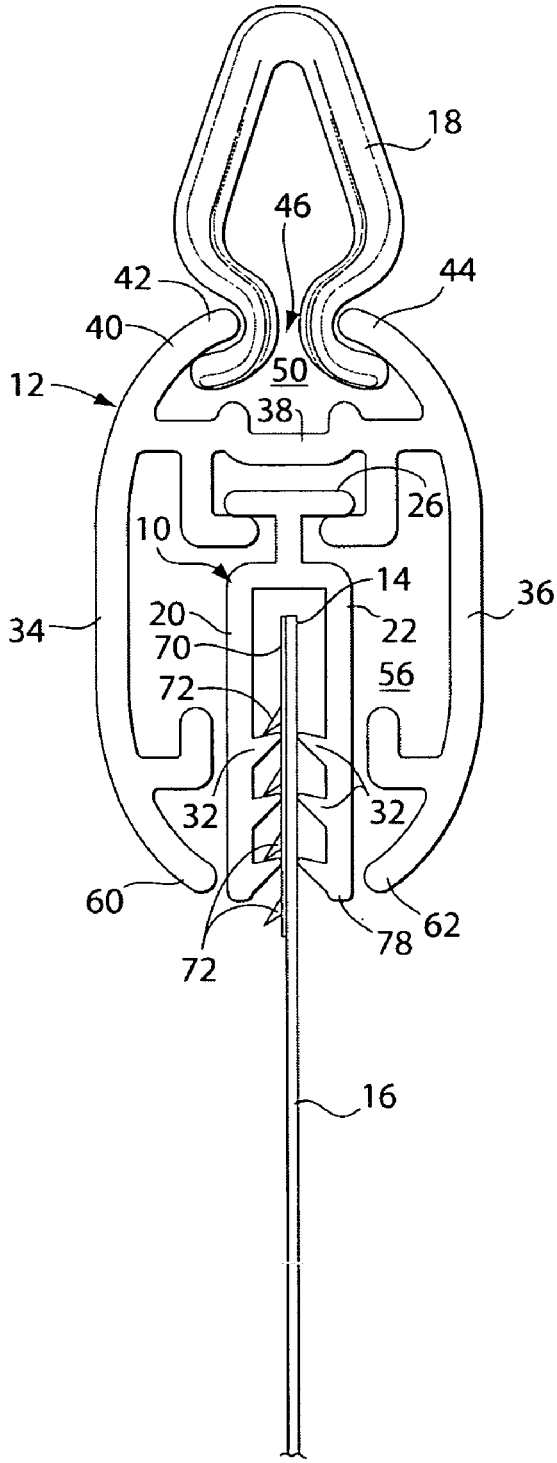
FIG. 5 is an end view of the elongated extruded outer housing supportively enclosing the elongated inner housing which itself supports a display panel having an elongated fastener element in longitudinal alignment with the ribs on the inner sidewalls of that elongated inner housing, the elongated outer housing being shown supported by an overhead support member.

Referring now to the drawings in detail, and particularly to FIGS. 1, 2 and 3, there is shown the present invention which comprises a first or inner elongated extrusion or housing 10, shown in an end view in FIG. 1, which extrusion 10 is slidably receivable within a second or outer elongated extrusion housing 12, shown in several cross-sectional shapes as an end view in FIGS. 2, 3, 3A, 3B and 3C. The inner elongated extrusion 10 is arranged to slidably receive the upper edge 14 of a display panel 16, as represented in FIG. 5. In one preferred embodiment, the outer elongated extruded second or outer housing 12 is arranged to slidably receive the elongated extruded first or inner housing 10 with its associated display panel 16 supported therewithin, as shown in FIG. 5 to facilitate support or rigidity thereof. The outer elongated extruded housing 12 may be supported by an overhead support member 18 (shown in FIG. 5) which extends downwardly from an overhead ceiling rail or the like, or the housing 12 may also be supported by a stand arrangement or other tensioned apparatus, (not shown for clarity of viewing), or other areas where displaying a sign is desired.

The inner elongated extrusion 10 comprises a first or left side wall 20 and a second or a right side wall 22 joined together by an elongated bridge member 24 along an upper edge thereof, as represented in FIGS. 1 and 3. The bridge has a T-shaped support flange 26 projecting therefrom. The bridge 24 and the first side wall 20 and the second side wall 22 of the inner housing 10 form a generally inverted U-shaped channel 28 having an open, elongated lower end 30 thereon, as best shown in FIG. 1. The first side wall 20 and the second side wall 22 each have an inner side with a plurality of elongated wedge shaped ribs 32 opposing one another in a slightly spaced-apart relationship. The first side wall 20 and the second side wall 22 also define between them the open inner channel 28 adjacent to the bridge member 24.

The elongated extruded outer housing 12 comprises a first sidewall 34 and a second sidewall 36 in an opposed and spaced apart relationship, as is shown in FIGS. 2, 3, 3A, 3B and 3C. The sidewalls 34 and 36 represented in FIGS. 3A, 3B and 3C differ in cross-sectional shape from the side walls 34 and 36 shown in FIG. 2, to permit such second or outer elongated housing 12 present a further aesthetic appeal to a commercial user thereof, while still remaining within the confines of the invention. A unitary bridge member 38 extends between the first sidewall 34 and the second sidewall 36 close to a first or proximal end 40 of the outer housing 12. The proximal end of the sidewalls 34 and 36 define opposed proximal ends 42 and 44 which are spaced apart to define a slot 46 therebetween, as represented in FIGS. 2 and 3.

An elongated support receiving channel 50, shown in FIGS. 2 and 3, comprises the space 46 between those proximal ends 42 and 44 and the bridge member 38 connecting the sidewalls 34 and 36. A first flange 52 and a second flange 54, which are "L-shaped" as represented in FIGS. 2, 3, and 3B extend distally within an elongated internal chamber 56 between the body portions of the first sidewall 34 and the second sidewall 36.

Figure 3C:
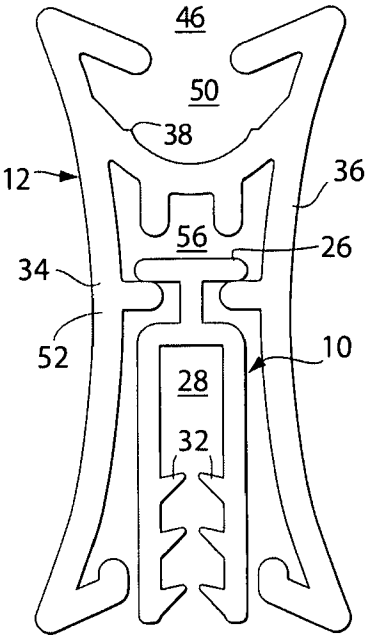
FIGS. 3A, 3B and 3C are end views of the elongated inner housing mated within the elongated internal chamber of the other embodiments of the elongated extruded outer housing.
Figure 3B:
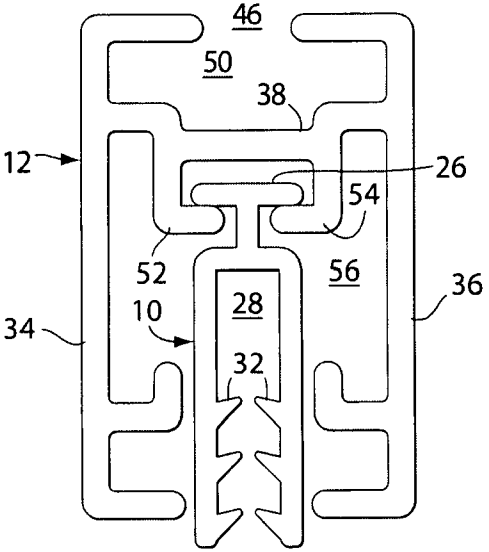
Figure 3A:
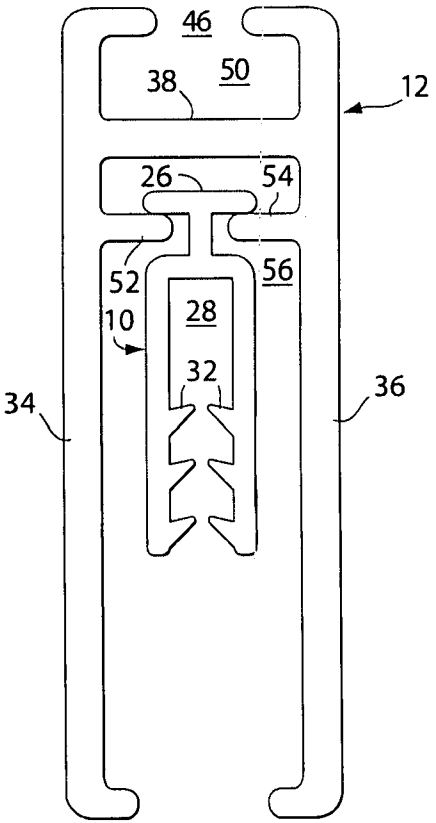

Those first and second flanges 52 and 54 extend laterally inwardly into the chamber 56 of the second housing 12, in a further embodiment, from the sidewalls 34 and 36, as represented in FIGS. 3A and 3C. In each flange embodiment, the first and second flanges 52 and 54 are opposed to one another and are separated so as to define a receiving slot 58 between one another within the chamber 56, as represented in FIGS. 2, 3, 3A, 3B, 3C and 5. The first sidewall 34 and the second sidewall 36 have lower edges 60 and 62 at their respective distal ends, and are separated from one another so as to define an elongated opened slot 64 therebetween, as represented in FIGS. 2, 3 and 5.

In one preferred embodiment of the present invention, the elongated extruded first or inner housing 10 is longitudinally slid into the elongated internal chamber 56 between the first sidewall 34 and the second sidewall 36, as represented in FIGS. 3, 3A, 3B, 3C and 5. The T-shaped support flange 26 extending perpendicularly from the bridge member 24 of the elongated extruded inner housing 10 mates within the elongated channel 58 which extends between a the first L-shaped flange 52 and the second L-shaped flange 54 within the elongated internal chamber 56 of the elongated extruded outer housing 12.

Figure 4:
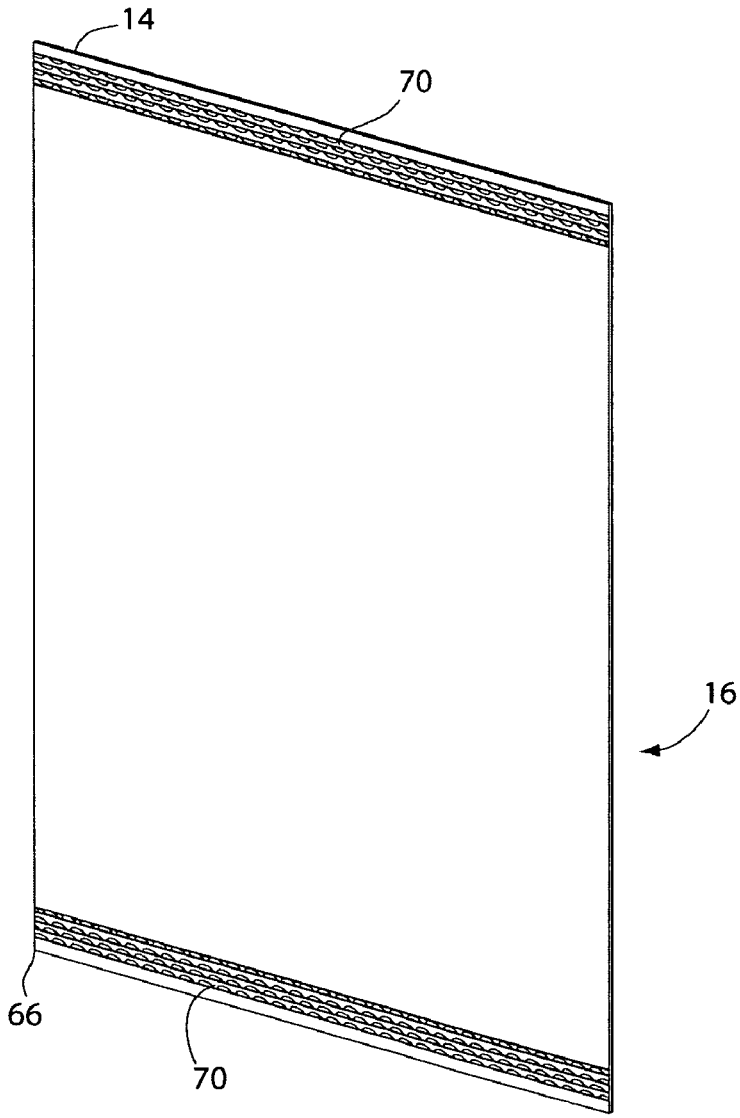
FIG. 4 is a perspective view of a display panel having an upper end with an elongated fastener element thereon and with a lower end also with an elongated fastener element thereon.

A sign or substrate which will be a display panel 16, for use within a commercial establishment, may be a flexible piece of paper, plastic or cloth or it may be a rigid piece of paper, plastic or the like. The sign substrate 16, represented in FIGS. 4, 5 and 6, has an uppermost edge 14 and also a lower most edge 66 on which an elongated fastener element 70 is adhered. Such an elongated fastener element 70 may be seen for example, in incorporated U.S. Pat. No. 7,478,460 to Gallant et al. The elongated fastener element 70, which is for example, found in this patent, has longitudinally aligned wedge-shaped engagement elements 72. Those engagement elements 72 slide along the parallel, longitudinally-aligned inwardly extending ribs 32 on one or both of the inner sides 20 and 22 of the inner channel of the elongated extruded inner housing 10 when they are mated together, as represented in FIGS. 5 and 6.

The elongated extruded inner housing 10 has a lower or distal end 78 which preferably extends just beyond the distalmost end of the lower distal most edges 60 and 62 of the opposed sidewalls 34 and 36 of the elongated extruded outer housing 12, as represented in FIGS. 3, 3B, 3C and 5. A printed portion of that substrate 16, as part of a display, would extend beneath the elongated extruded inner housing 10, and concomitantly extend beyond the elongated extruded outer housing 12.

Figure 6:
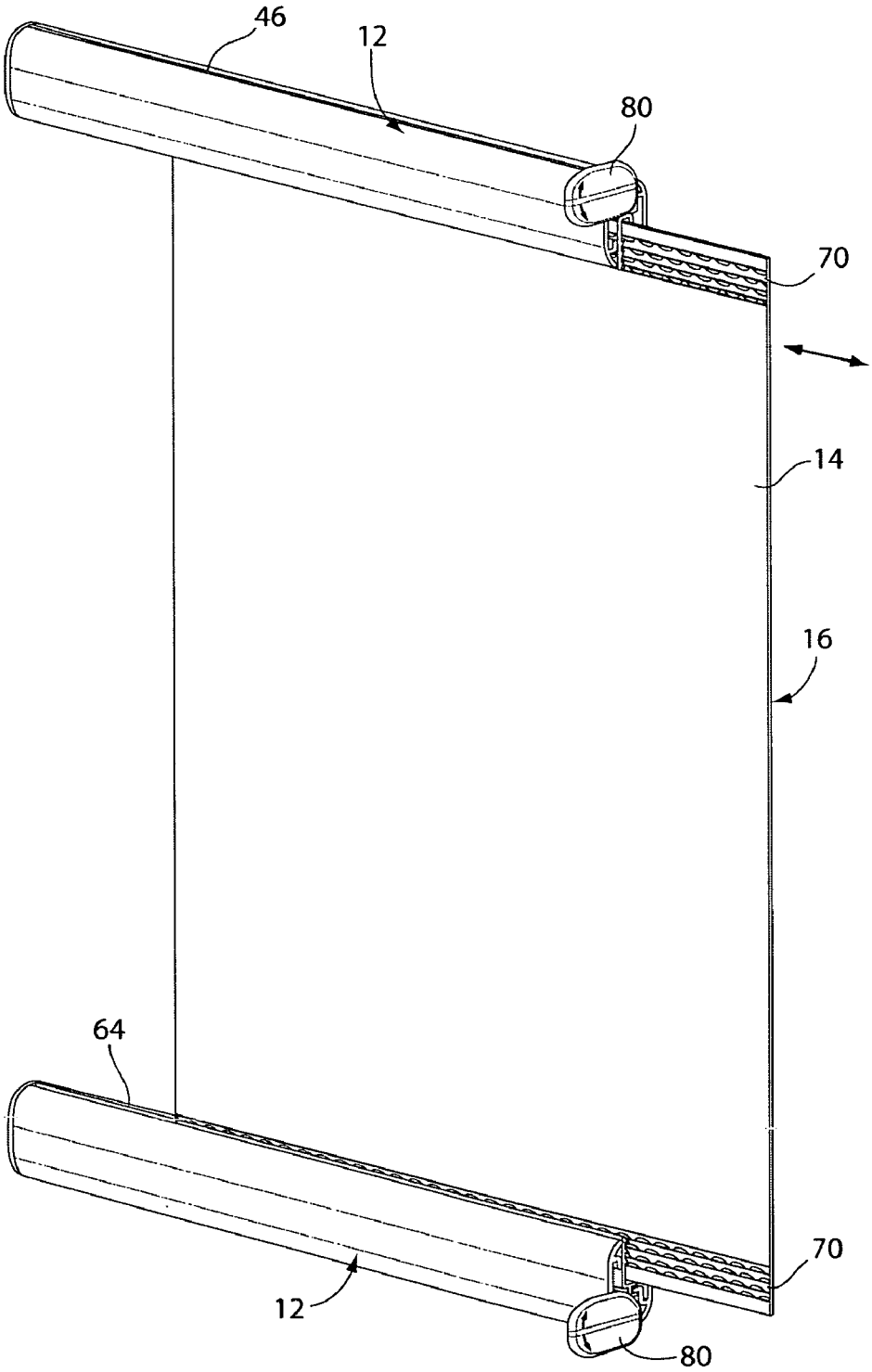
FIG. 6 is a perspective view of a display panel shown supported between an upper elongated extruded outer housing and a lower extruded elongated outer housing, with its end caps rotated out of way to permit longitudinal (horizontal) movement of that display panel.

A similar elongated extruded inner housing 10 and an elongated extruded outer housing 12 may, in a further embodiment, be situated along the lower edge of the display panel 16 in a properly supported relationship, as represented in FIG. 6. The lower end 66 of the display panel 16 would have a similar elongated fastener element 70 attached thereon. Those elongated fastener elements 70 would be preferably placed on the display panel during and or immediately subsequent to the printing of that display panel advertisement.

The elongated extruded outer housing 12 would preferably have an end cap 80 on each end thereof, as represented in FIG. 6, which may be snapped in or pivoted about a pivot point, so as to permit a display panel 16 slid therewithin, to remain securely trapped longitudinally (and horizontally) therewithin, that is, prevented from being pulled perpendicularly therefrom, until it is desired to have the display panel removed or changed.

The invention claimed is:

1. A method for supporting a display panel from an upper housing comprising:

forming an array of longitudinally aligned ribs within a pair of parallel opposed walls of an elongated extruded first or inner housing;

attaching an elongated fastener element onto an upper edge of the display panel;

sliding the upper edge of the display panel with the elongated fastener element thereon into the inner housing between the opposed walls having longitudinally aligned ribs therewithin, wherein the ribs and the elongated fastener each have at least one side with a corresponding engagement configuration thereon; and sliding the elongated inner housing longitudinally within an elongated channel in an outer housing, and wherein the attaching of the elongated fastener element to the edge of the display panel occurs during a printing operation upon that display panel.

2. The method as recited in claim 1 wherein the elongated fastener element has a set of longitudinally aligned wedge shaped members arranged thereon.

3. The method as recited in claim 1, wherein the display panel has a lower edge with an elongated fastener element applied thereon.

* * * * *